US005529509A

United States Patent [19]

Hayes et al.

[11] Patent Number: 5,529,509

[45] Date of Patent: Jun. 25, 1996

[54] INTERLOCKING GROUND TERMINAL

[75] Inventors: Earl J. Hayes, Northville; Stefano Sapdoni, Livonia; Dhananjay B. Kulkarn, Canton, all of Mich.

[73] Assignee: Alcoa Fujikura Limited, Brentwood, Tenn.

[21] Appl. No.: 439,735

[22] Filed: May 12, 1995

[51] Int. Cl.[6] ..... H01R 13/28

[52] U.S. Cl. ..... 439/288; 439/883

[58] Field of Search ..... 439/284, 286, 439/287, 288, 290, 868, 883

[56] References Cited

U.S. PATENT DOCUMENTS

| | | | |
|---|---|---|---|
| 3,316,522 | 4/1967 | Demler, Sr. | 439/288 |
| 4,273,401 | 6/1981 | Katzin | 439/286 |
| 4,357,070 | 11/1982 | Fukushima et al. . | |
| 4,983,133 | 1/1991 | Van Scyoc et al. | 439/883 X |
| 5,188,544 | 2/1993 | Mukai | 439/287 X |
| 5,266,046 | 11/1993 | Bogiel . | |

FOREIGN PATENT DOCUMENTS

| | | | |
|---|---|---|---|
| 881914 | 11/1961 | United Kingdom | 439/284 |

*Primary Examiner*—Jes F. Pascua
*Attorney, Agent, or Firm*—Tracey D. Beiriger

[57] ABSTRACT

Disclosed is a ring terminal connector which includes a pair of like circular, substantially flat apertured terminals. Each terminal has a raised bump or nib on its upper surface and a nib opening on its upper surface such that the pair of terminals may be interlocked by fixing the raised nib of each terminal in the nib opening of the other terminal. The terminals also each have a pair of inwardly directed slotted flanges and an elongated opening or groove to properly orient one terminal with respect to the other. One of the terminals may be turned over and engaged with the other terminal such that by rotating one relative to the other, the terminals may be interlocked. Further, the terminals each have an integral outwardly directed crimping arm to receive wires and maintain a positive connection between the connector and the wires and/or the bolt to which the connector is attached. The nib, elongated opening, nib opening and slotted flanges are circumferentially located such that the crimping arms do not interfere with each other when the terminals are interlocked.

5 Claims, 3 Drawing Sheets

INTERLOCKING GROUND TERMINAL

FIELD OF THE INVENTION

The present invention relates to a pair of electrical flat interlocking ring terminal connectors. The connectors are of identical configuration and are designed such that by turning over one of the terminals and rotating it, the pair of terminals can be interlocked.

BACKGROUND OF THE INVENTION

Generally, to interconnect components in electrical type equipment, a wire harness is assembled by connecting electrical connectors to a network of wires located in accordance with a programmed or predetermined layout of the components. Because the process of assembling electrical equipment is often done on a moving conveyor, it is important that the connectors can be quickly and correctly attached to terminal bolts of the electrical equipment. Interlocking electrical ring terminals are often used as such connectors.

Interlocking electrical ring terminal connectors are known in the art, as evidenced by Fukushima et al U.S. Pat. No. 4,357,070. Further, hermaphroditic terminals are also known as disclosed in U.S. Pat. No. 5,266,046 to Bogiel. Typically, a hermaphroditic terminal, a terminal that can mate with itself, includes a front terminal mating end and a rear conductor connecting end. It is desirable to provide a ring terminal that may be easily aligned for mating with a ring terminal of identical configuration.

It is a principal objective of the present invention to provide a ring terminal that can be easily aligned and mated with an identical ring terminal.

It is a further objective of the present invention to provide an electrical ring terminal connector comprised of two-ting terminals that can attain good positive electrical contact when mated together.

One advantage of the present invention is that because the interlocking terminals are of identical configuration, only one type of tooling is required to fabricate the terminals.

SUMMARY OF THE INVENTION

This invention is directed to a ring terminal connector which includes a pair of like circular, substantially flat apertured terminals. Each terminal has a raised bump or nib on its upper surface and a nib opening on its upper surface such that the pair of terminals may be interlocked by fixing the raised nib of each terminal in the nib opening of the other terminal. The terminals also each have a pair of inwardly directed slotted flanges. To properly orient one terminal with respect to the other terminal, the terminals have an elongated opening or groove. One of the terminals may be turned over so that its nib is placed inside the elongated opening of the other terminal. The terminals are now rotated relative one to the other so that the nib travels in the opening until the slotted flanges of the terminals are engaged. The slotted flanges help guide the terminals once they are properly oriented to a proper lock position by keeping the terminals interlocked until the nib of each terminal is engaged securely in the nib opening of the other terminal. Further, the terminals each have an integral outwardly directed crimping arm to receive wires and maintain a positive connection between the connector and the wires and/or the bolt to which the connector is attached. The nib, elongated opening, nib opening and slotted flange are circumferentially located such that the crimping arms do not interfere with each other when the terminals are interlocked.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF PREFERRED EMBODIMENTS

Figure 1:
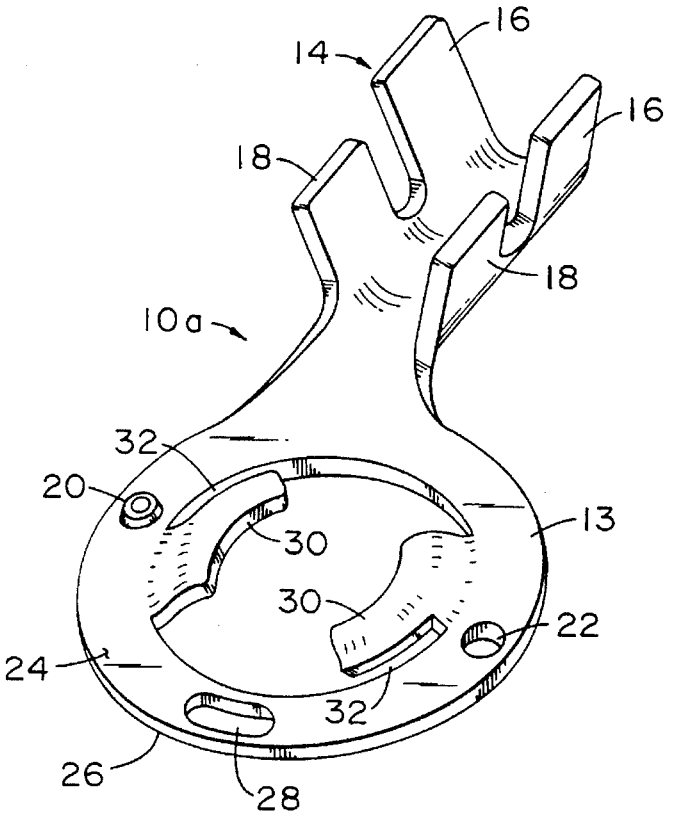
FIG. 1 is a perspective view of one of the identical terminals forming the ring terminal connector of the invention.

Referring to the drawings in greater detail, and first to FIG. 1, a circular, flat apertured terminal, generally designated 10*a*, is one of a pair of like terminals which form an electrical ring terminal connection 12 according to the invention. That is, a second terminal 10*b* identical to terminal 10*a* can be turned over, engaged with terminal 10*a* and rotated approximately 90° to form an interlocking ring terminal connector 12, as described hereinafter in relation to FIGS. 3 and 4.

More particularly, as shown in FIG. 1, each of the pair of like terminals 10*a* and 10*b* which form the interlocking ring terminal connector 12 is a circular structure 13 that includes an integral outwardly directed crimping arm 14 which has two pairs of fingers 16 and 18. Fingers 18 may be adapted for crimping onto the conductive core of an insulated wire, while fingers 16 are clamped onto the outer insulated cladding of the wire to provide strain relief, as known in the art.

As also shown in FIG. 1, each terminal 10*a* and 10*b* includes a raised nib 20 and a nib opening 22 on its upper surface 24 of circular structure 13. The nib opening 22 preferably extends through entire terminals 10*a* and 10*b* such that it is also evident from lower surface 26 of terminals 10*a* and 10*b*. This allows a user to visually check that the pair of terminals are securely interlocked. When the pair of terminals are interlocked and in their proper resting position, raised nib 20 of each terminal sits snugly in nib opening 22 of the other terminal.

Each terminal 10*a* and 10*b* further has a somewhat elongated opening or open groove 28 on its upper surface 24 of circular structure 13 that preferably extends through entire terminal 10*a* and 10*b* such that it also evident from lower surface 26 of terminals 10*a* and 10*b*. This allows a user to visually check that the pair of terminals are properly aligned for mating.

Terminals 10*a* and 10*b* also include a pair of integral inwardly directed slotted flanges 30 on circular structure 13, i.e., each flange is provided with a slot 32 that extends part way into the flange body. This is best seen in FIG. 1. Openings 28 and slotted flanges 30 help to orient and to guide terminal 10*a* with respect to terminal 10*b* when the two like terminals 10*a* and 10*b* are mated to form ring terminal connector 12.

Figure 2:
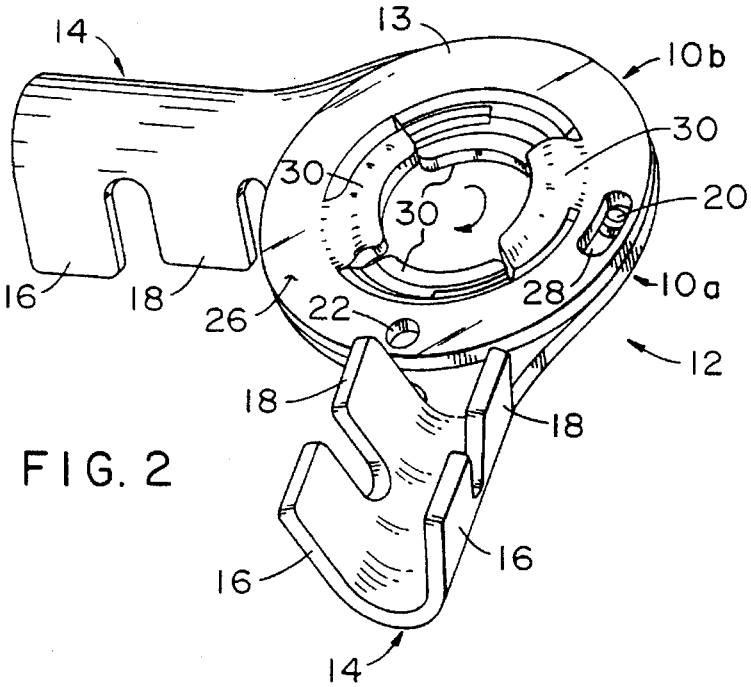
FIG. 2 is a perspective view of the pair of identical terminals stacked and engaged prior to rotating and interlocking the two terminals.

More specifically, as shown in FIG. 2, two like terminals 10*a* and 10*b* are stacked prior to locking, i.e., terminal 10*b* is turned over and mated with the terminal 10*a* so that raised nib 20 of terminal 10*a* is placed in opening 28 of terminal 10*b*. Opening 28 is circumferentially positioned approximately 90° away from nib opening 22 so that once the like terminals are stacked, one of the terminals can be rotated approximately 90° to engage nib 20 of terminal 10*a* in nib opening 22 of terminal 10*b*.

Figure 3:
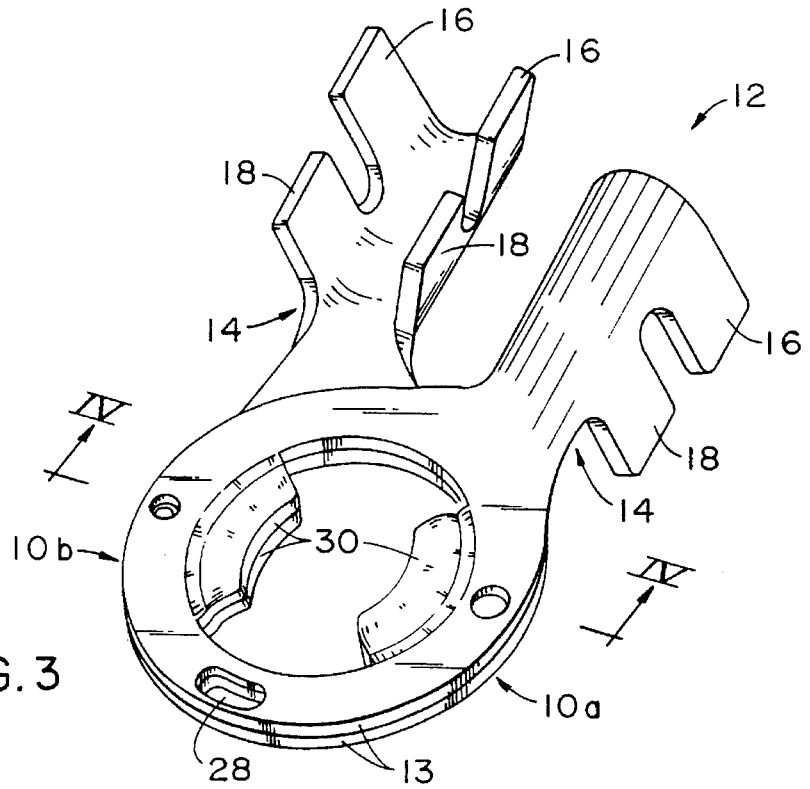
FIG. 3 is a perspective view of the two interlocked terminals.
Figure 4:
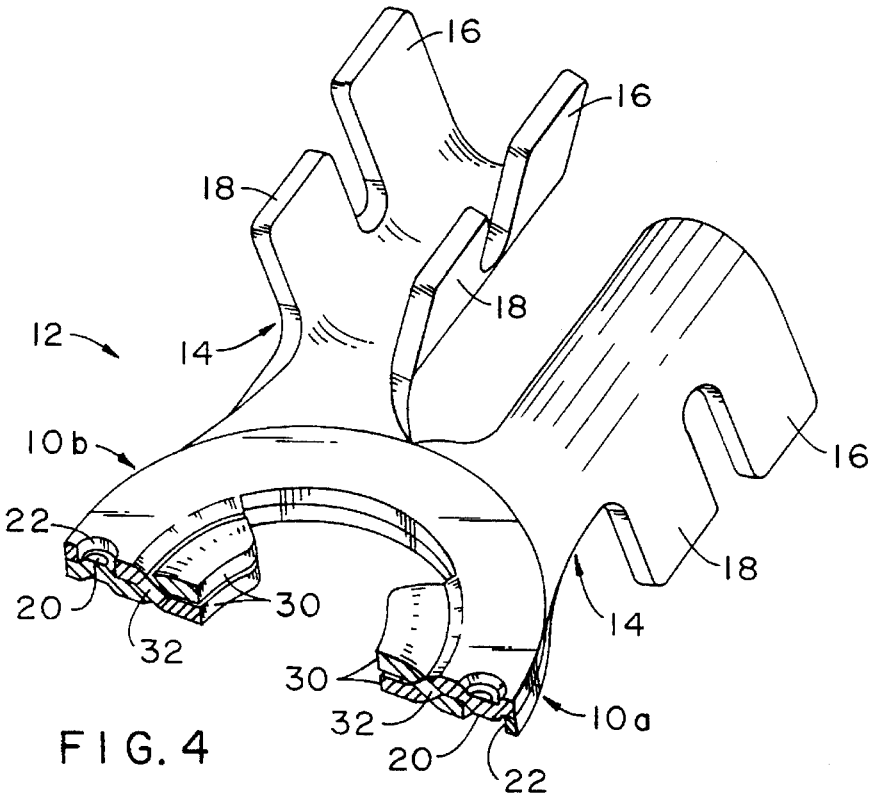
FIG. 4 is a partial three-dimensional isometric and sectional view of the two interlocked terminals showing a sectional view taken along the line IV—IV of FIG. 3.

Nib 20 slides along opening 28 as one of the stacked terminals are rotated. Further, as nib 20 slides along opening 28, the slotted flanges 30 of the two terminals begin to engage as one flange enters the slot 32 of the other. When nib 20 reaches the end of opening 28, the slotted flanges 30, now even further engaged, act as lateral guide tracks for terminals 10*a* and 10*b*. Nib 20 slides out of opening 28 of terminal 10*a* and continues to slide along lower surface 26 of terminal 10*b* until the nib reaches and locks into nib opening 22 of terminal 10*b*, as shown in FIGS. 3 and 4. Because nib 20 and nib opening 22 are located 180° circumferentially apart, when nib 20 of terminal 10*a* engages the nib opening of terminal 10*b*, nib 20 of terminal 10*b* also engages nib opening 22 of terminal 10*a*.

It should be noted that nib openings 22, openings 28 and slotted flanges 30 are circumferentially located about the circular structure 13 such that the outwardly extending crimping arms 14 to not interfere with each other as the terminals are rotated to an interlocked position.

Figure 5:
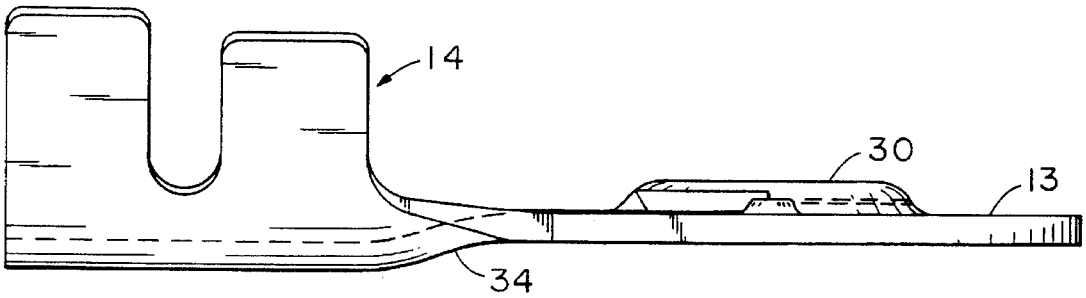
FIG. 5 is a side view of one of the identical terminals provided with offset to prevent rotation of the terminals as they are being attached and after they are attached to a mounting surface.
Figure 6:
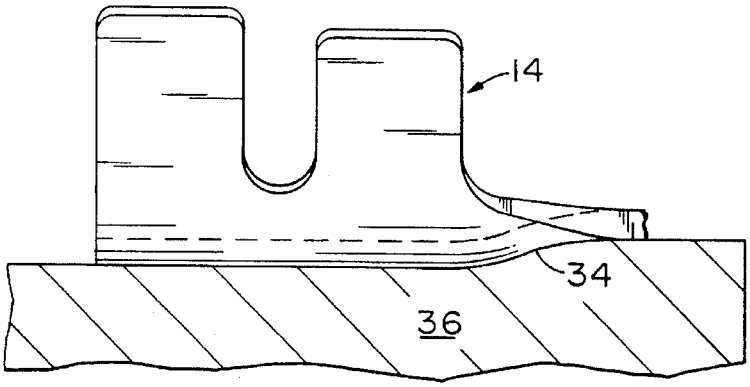
FIG. 6 is a side view of one of the identical terminals having the offset of FIG. 5 affixed to a mounting surface.

In an alternative embodiment, the ring terminals 10*a* and 10*b* are formed to prohibit rotation when being bolted to the desired surface. FIG. 5 shows a material offset 34 between the circular structure 13 (not shown) and the crimping arm 14. The surface 36 to which ring terminal connector 12 is to be affixed will be formed to correspond to offset 34 as shown in FIG. 6. Matching surface 36 to ring terminals 10*a* and 10*b* provides connector 12 with an anti-rotational capability since crimping arm 14 will firmly rest in an embossment of the attaching surface prohibiting the ring terminal from rotating when the same is bolted to surface 36.

Having described the presently preferred embodiments, it is to be understood that the invention may be otherwise embodied within the scope of the appended claims.

What is claimed is:

1. A pair of identical terminals, each said terminal having a substantially flat circular structure about an aperture and fingers for attachment to an electrical wire, each said terminal comprising:

a raised nib on said circular structure;

an elongated groove in said circular structure;

an opening in said circular structure, said nib, groove and opening being spaced from one another about said circular structure;

a pair of flanges, each said flange forming a slot in said opening adjacent said circular structure;

said nib, groove, opening and flanges being configured such that upon positioning one terminal coaxially adjacent the other with a nib of said one terminal in said groove of the other terminal and then rotating said one terminal relative to the other, said nib sequentially traverses said groove and the space on said circular structure between said groove and said opening and then positions in said opening while said flanges of said one terminal interlock with said slots of said other terminal.

2. An interlocking electrical terminal connector comprising:

a pair of circular, substantially flat apertured terminals each adapted to be secured to the end of an electrical wire, said terminals being of identical configuration and each having a first and second surface;

each of said terminals having a raised nib on said first surface;

each of said terminals having an elongated opening;

each of said terminals having an opening for receiving said nib; and each of said terminals having a pair of inwardly directed flanges having slots sized to receive each other's flanges when one terminal is turned over and its nib is placed in the elongated opening of said other terminal, and when at least one of said terminals is then rotated relative to the other, the raised nib of said one terminal travels in the opening of said other terminal until the slotted flanges of said terminals engage such that with continued rotation, the raised nib is no longer located in said opening, the terminals remain engaged and the raised nib of said one terminal enters into the nib opening of said other terminal and the raised nib of said other terminal enters into the nib opening of said one terminal.

3. An interlocking electrical terminal connector comprising:

a pair of circular, substantially flat apertured terminals each adapted to be secured to the end of an electrical wire, said terminals being of identical configuration and each having a first and second surface;

each of said terminals having a circular structure and an integral outwardly directing crimping arm;

each of said terminals having a raised nib on said first surface of said circular structure;

each of said terminals having an elongated opening on said circular structure;

each of said terminals having an opening for receiving said nib; and each of said terminals having a pair of integral inwardly directed flanges on said circular structure having slots sized to receive each other's flanges when one terminal is turned over and its nib is placed in the elongated opening of said other terminal, and when at least one of said terminals is then rotated relative to the other, the raised nib of said one terminal travels in the opening of said other terminal until the slotted flanges of said terminals engage such that with continued rotation, the raised nib is no longer located in said opening, the terminals remain engaged and the raised nib of said one terminal enters into the nib opening of said other terminal and the raised nib of said other terminal enters into the nib opening of said one terminal.

4. A terminal connector as set forth in claim 3 in which said crimping arm includes at least one pair of fingers.

5. A terminal connector as set forth in claim 3 in which each of said terminals includes a material offset between said circular structure and said crimping arm, said material offset prohibiting rotation when said connector is affixed to a surface having a configuration corresponding to that of said terminal with the material offset.

* * * * *